United States Patent [19]

Santoni

[11] 4,263,860

[45] Apr. 28, 1981

[54] SEAL DRUM WITH END CLOSURE HAVING REINFORCED SEAMS

[75] Inventor: Cesar Santoni, Hamilton, Canada

[73] Assignee: Greif Bros. Corporation, Delaware, Ohio

[21] Appl. No.: 49,227

[22] Filed: Jun. 18, 1979

[51] Int. Cl.[3] ..... B21D 51/32

[52] U.S. Cl. ..... 113/120 Y; 113/121 A; 220/67; 220/78

[58] Field of Search ..... 113/1 E, 1 F, 120 K, 113/120 M, 120 Y, 121 R, 121 A, 121 C; 220/67, 78, 79

[56] References Cited

U.S. PATENT DOCUMENTS

| | | | |
|---|---|---|---|
| Re. 29,307 | 7/1977 | Wessely | 113/120 Y X |
| 3,416,476 | 12/1968 | Wyss | 113/121 R X |
| 3,736,893 | 6/1973 | Coppe ns et al. | 220/67 X |
| 3,907,152 | 9/1975 | Wessely | 220/66 |
| 4,055,133 | 10/1977 | Wessely | 113/120 X |
| 4,089,283 | 5/1978 | Mertens et al. | 113/120 K |

FOREIGN PATENT DOCUMENTS

| | | | |
|---|---|---|---|
| 2308215 | 8/1974 | Fed. Rep. of Germany | 220/67 |

OTHER PUBLICATIONS

"Spiral Plus", by Schonug, The Safe Seam, 11-1973.

*Primary Examiner*—Howard N. Goldberg
*Attorney, Agent, or Firm*—Kane, Dalsimer, Kane, Sullivan and Kurucz

[57] ABSTRACT

A drum with sealed end closures and the method of forming the drum in which a tubular shell is formed to define drum side walls. An end closure is applied to at least one end of the shell with the adjacent peripheral edges of the shell end closure being formed into a circumferentially extending chime with the peripheral edges defining said chime being in abutting surface-to-surface contact and folded to provide a seam with five layers of material of said edges being in a transverse radial direction. The chime is thereafter formed into a reinforced chime folded to provide a seam of predetermined shape with seven layers of material of the edges being in a transverse radial direction and having increased sealing, handling, and strength characteristics while retaining a minimum desired length for the seam.

9 Claims, 13 Drawing Figures

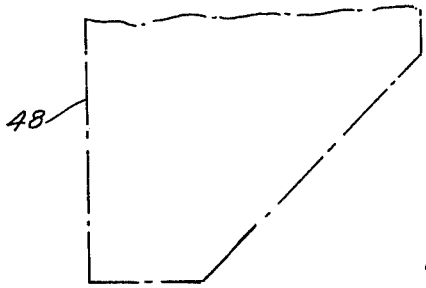
FIG. 5
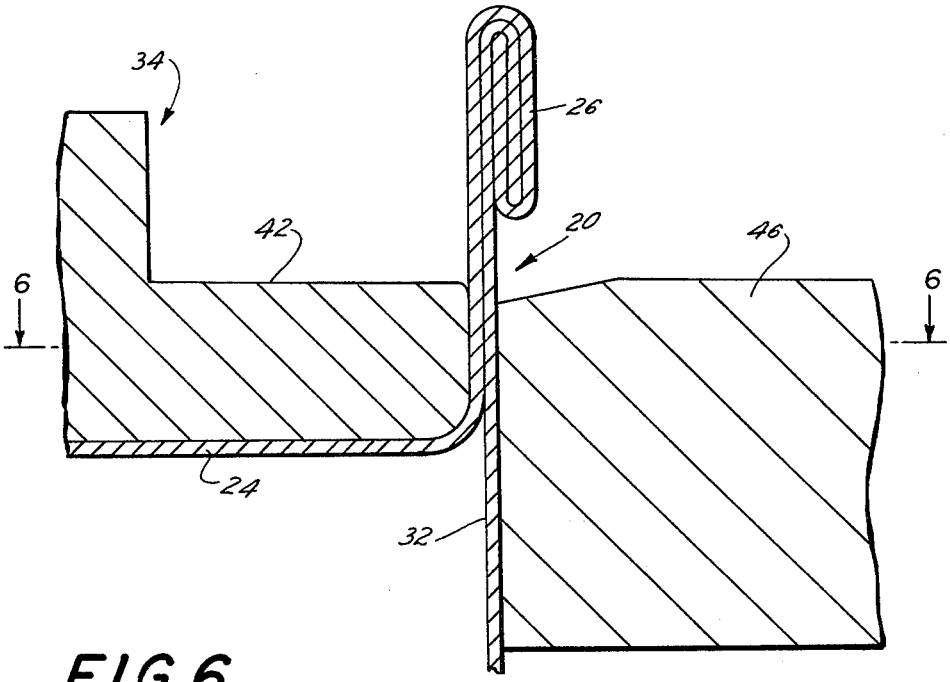
FIG. 6
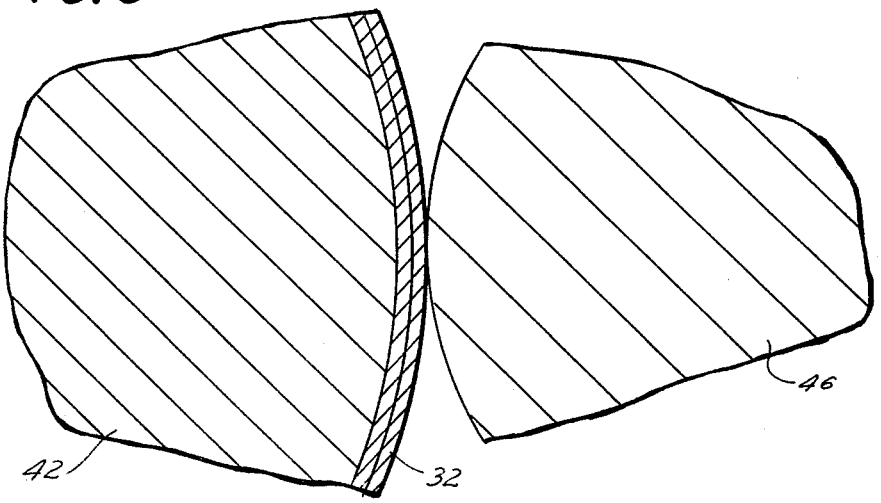

SEAL DRUM WITH END CLOSURE HAVING REINFORCED SEAMS

BACKGROUND OF THE INVENTION

It has been conventional practice to fabricate industrial steel drums with at least the bottom end having a five ply closure. With the increase in the cost of steel as well as its scarcity, it has become desirable to construct drums of thinner gauge metal. However, the standard five ply end closure in many instances will not be sufficiently strong, sturdy and durable to withstand the contemplated and normal use and abuse as well as prescribed governmental testing, i.e. rupturing or otherwise failing under standard drop tests.

In the past, a conventional technique employed for many years, in the manufacture of steel drums, barrels and containers of the industrial variety initially formed a cylinder of sheet steel, rolled, welded, or mechanically joined along its longitudinal edges. The cylinder was then flanged at both ends in a press or rolling machine. This flanged cylinder was then stiffened with two or more rolling hoops or stiffening corrugations around its circumference at strategic locations. This cylinder could also be flanged at one one end and beaded or rolled at the other for providing open mouth containers.

On a machine known in the trade as a double seamer, the cylinder with the flanged ends was then assembled at each end to a flanged, steel closure in the form of stamping with various circumferential corrugations or strengthening ribs around its periphery to provide the bottom and top head of the container. In the full open mouth design, a bottom would be formed in this manner and the top provided with a reasonable cover or lid.

SUMMARY OF THE INVENTION

It is a primary objective to provide an improved process for manufacturing a drum of thin gauge metal having an end construction formed with a seven ply seam of optimum increased strength with the option to apply sealant along anyone or all the seams.

It is also a principal objective of the present invention to permit refurbishing and reconditioning with another seam to thereby provide bottom and/or top seams that are strengthened and rendered leakproof.

Another important advantage of the present invention is to provide a technique for reconditioning drum end seams by use of a stationary machine in a given plant or a portable machine used in the field for drums that are filled and difficult to handle. Thus, the method of the present invention produces an improved drum with sealed and materially strengthened end closures. The drum, is initially formed into a tubular shell defining the drum side walls. An end closure is applied to at least one end of the shell with the adjacent peripheral edges of the shell and closure being formed into a circumferentially extending chime with the peripheral edges defining said chime being in abutting surface-to-surface contact and folded to provide a seam, with five layers of material of said edges being in a transverse radial direction. The chime is then formed into a greatly reinforced seam of predetermined shape with seven layers of material of said edges being in a transverse radial direction and having superior sealing, dimensioning, handling and strength characteristics.

With the above objectives among others in mind, reference is made to the attached drawings.

BRIEF DESCRIPTION OF THE DRAWINGS

In the drawings:

FIG. 5 is an enlarged fragmentary sectional view of the container and apparatus of FIG. 4 and showing additional forming apparatus applied thereto;

FIG. 6 is an enlarged top sectional view of the apparatus and container of FIG. 5 taken along the plane of line 6—6 of FIG. 5;

DETAILED DESCRIPTION

Figure 1:
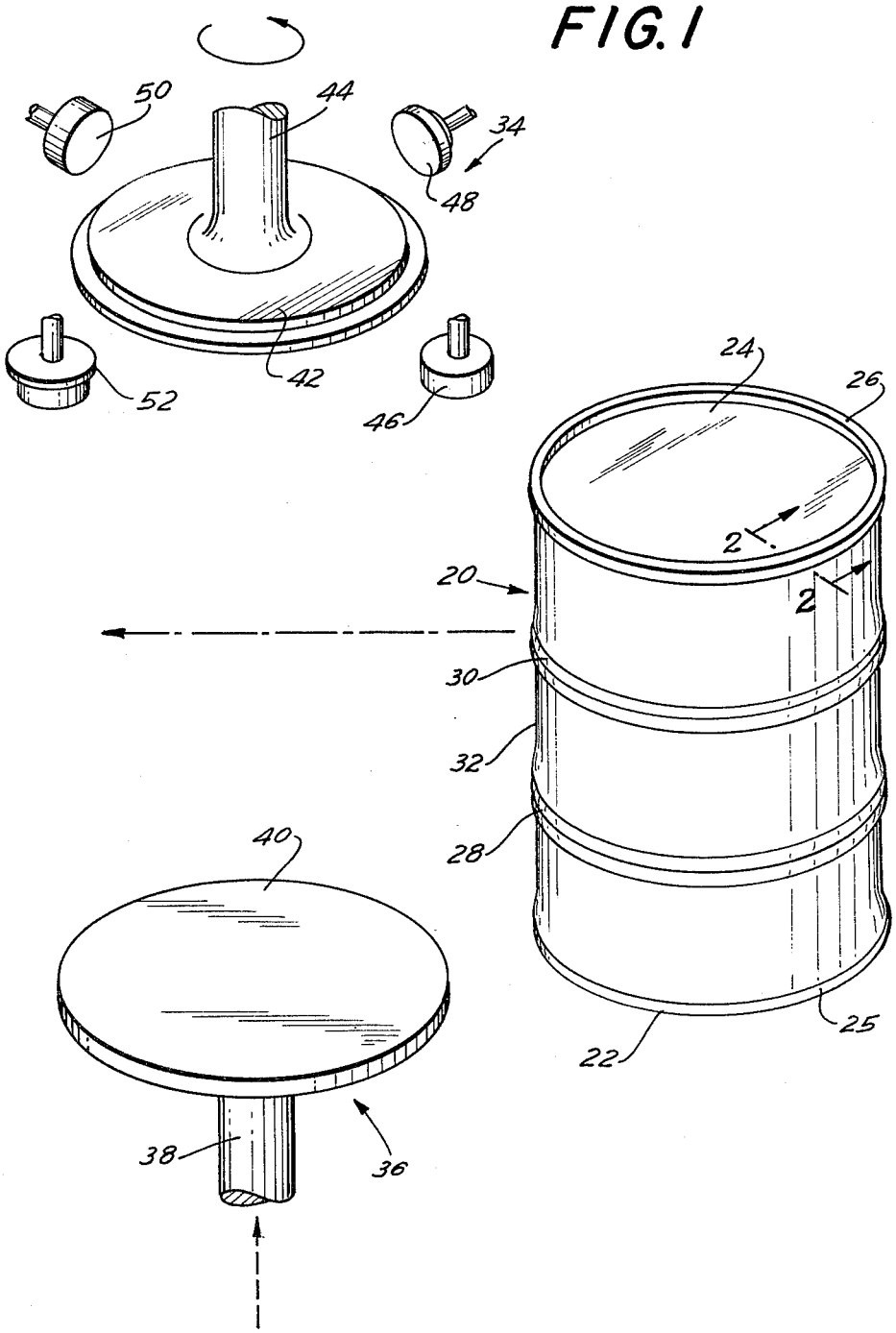
FIG. 1 is an exploded perspective view of the apparatus for forming the seamed drum and a container to be introduced into the apparatus.

In dealing with the present invention, it is possible to form the improved seam of the invention for the drum end closures on a new drum or to form a drum with end closures having a five ply seam at the top or bottom or both and then form the five ply or layer seam into a seven ply seam. In the depicted embodiment, a drum 20 is shown with a bottom closure 22 and a top closure 24 thereon. The bottom closure 22 is sealed to the drum 20 by means of a standard five ply seam 25 and similarly, the top closure 24 is sealed to the drum 20 by means of a standard five ply seam 26. A pair of conventional rolling rings 28 and 30 are spaced along the side walls of the tubular shell 32 of the drum 20. Drum 20 may be new and of thin gage metal or used and in need of refurbishing or reconditioning.

Standard forming machinery is employed with modifications as discussed below in regard to the tooling in order to form the five ply seam into an improved seven ply seam. The forming apparatus 34 in general is shown for forming the seven ply seam from the five ply seam 26 at the top end of the drum 20. It includes a bottom seamer 36 with a drive rod 38 and a chuck 40.

The upper end of the apparatus 34 includes a chuck 42 with a central drive rod 44 coupled therewith. The chuck is surrounded by a support roll 46, an angle roll 48, a flat roll 50, and a contour roll 52. All of the driver mechanisms and interconnecting apparatus (not shown) for these elements of apparatus 34 are conventional and well known in the art.

Figure 2:
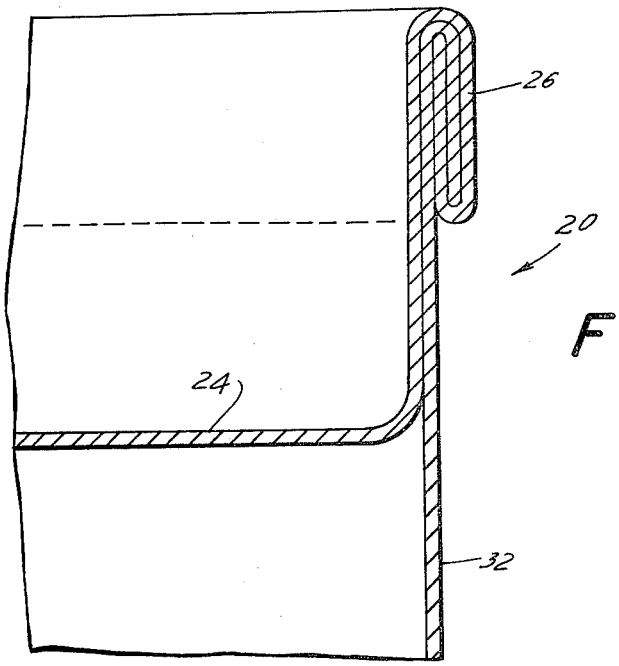
FIG. 2 is an enlarged fragmentary sectional view of the container showing a conventional five layer seam taken along the plane of line 2—2 of FIG. 1.

The details of the top end of drum 20 are shown in FIG. 2 whereby the tubular shell 32 terminates in the upper end with a five layer seam 26 forming a coupling with closure 24.

Figure 4:
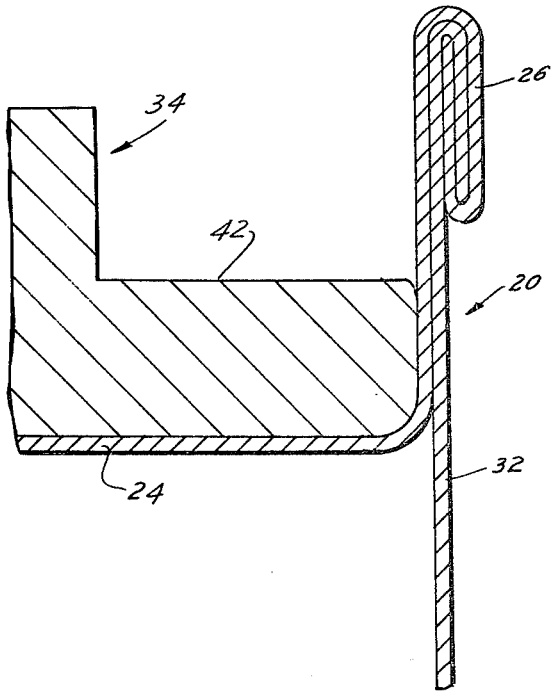
FIG. 4 is an enlarged fragmentary sectional view thereof taken along the plane of line 4—4 of FIG. 3.
Figure 3:
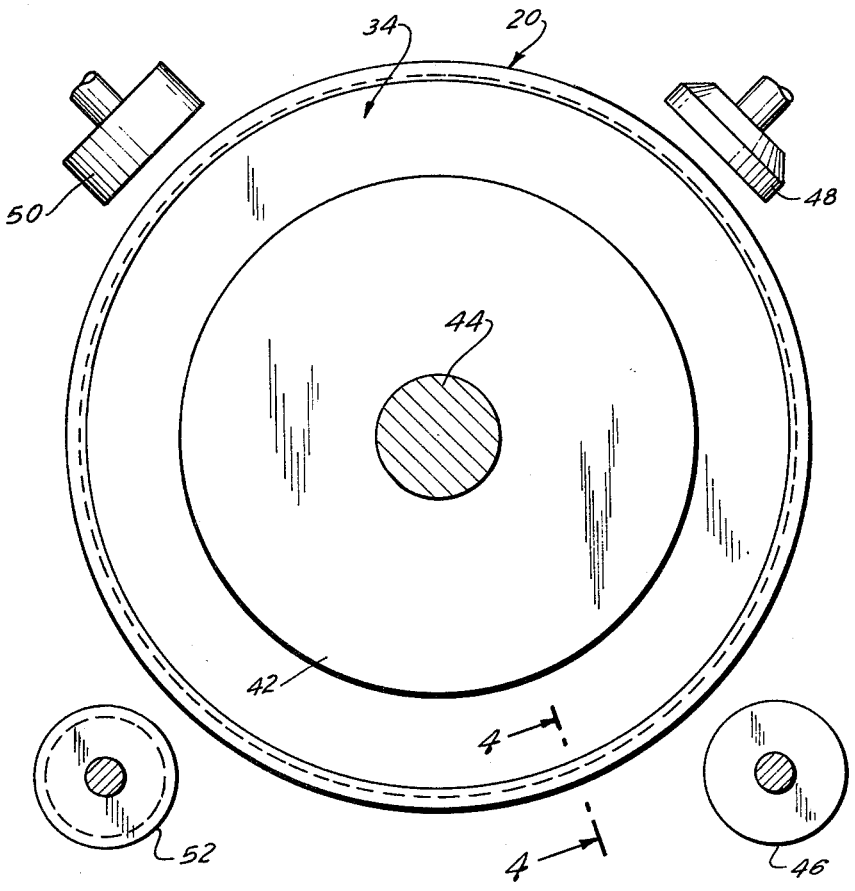
FIG. 3 is a top plan view of the container mounted in the forming apparatus.

This drum 20 is fed into the machine or apparatus 34. The chucks 40 and 42 are activated into the bottom and top heads of the container. The thickness of the chucks is smaller than the bottom of the double seam. This holds the drum 20 vertically in position and is depicted in FIG. 4.

As shown in FIG. 5, support roll 46 is then engaged with tubular shell 32. This holds the side wall of the shell against the side wall of the head or closure 24 thus keeping the container rigid with little chance of flexing. FIG. 6 depicts this interengagement from above.

Figure 7:
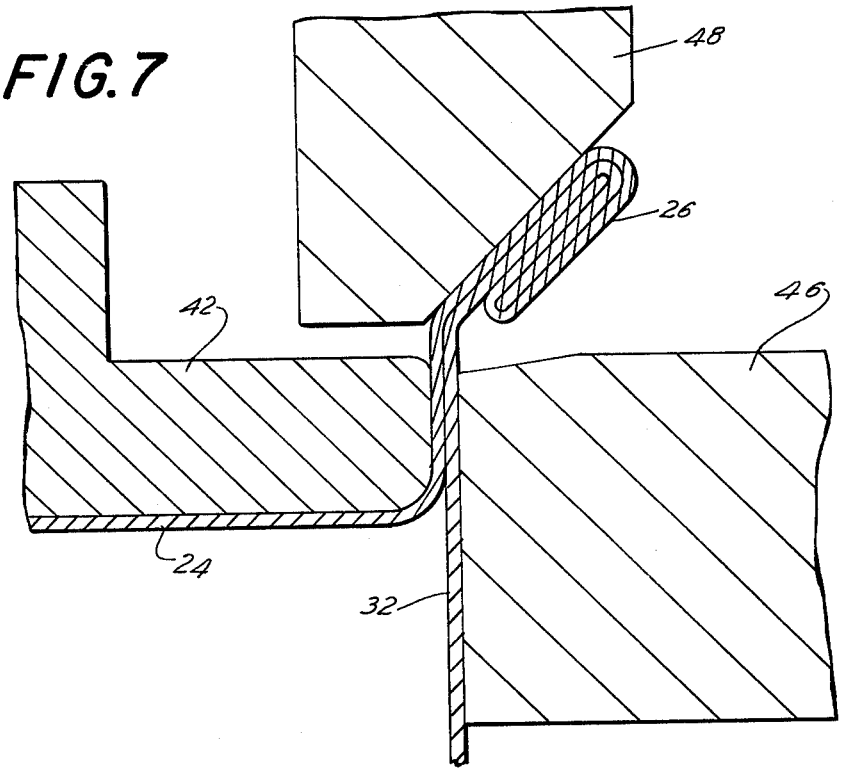
FIG. 7 is an enlarged fragmentary sectional view thereof with the apparatus having bent the seam at approximately a 45° angle.
Figure 8:
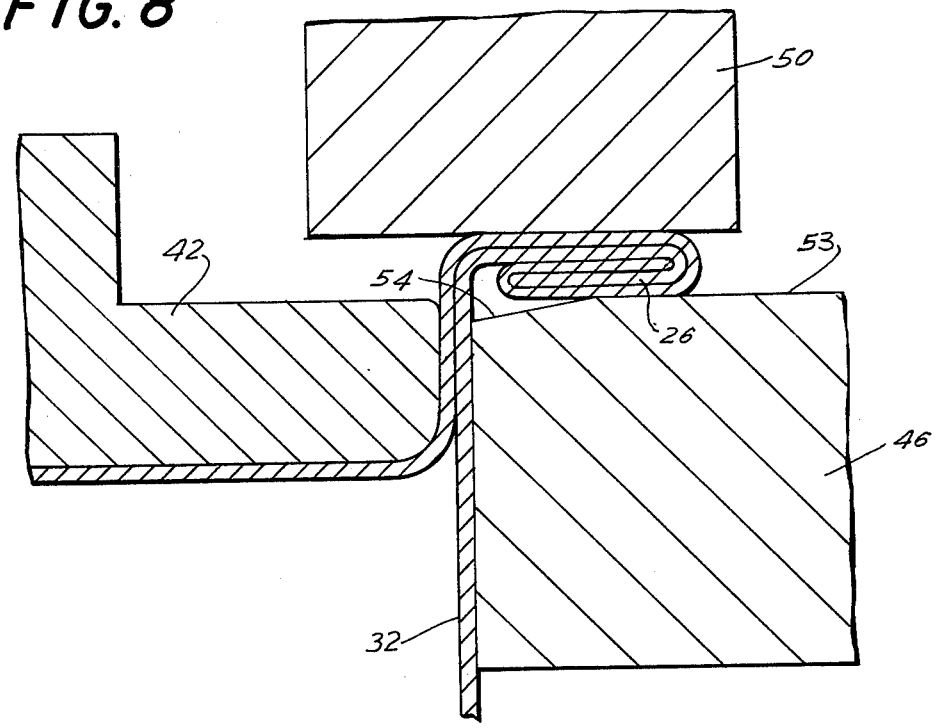
FIG. 8 is an enlarged fragmentary sectional view thereof with the apparatus having bent the seam to an approximate 90° angle.

As shown in FIG. 7 angle roll 48 is then activated proceeding inward to force the seam 26 into a bent position at approximately a 45° angle with respect to the longitudinal axis of the drum. This angle roll 48 then retracts and, as shown in FIG. 8, flat roll 50 proceeds forward and flattens the seam 26 against the upper surface of support roll 46. it should be noted that the flat upper surface 53 of support roll 46 has a beveled or angled inner portion 54 at a slight angle. This assists the seam 26 in retaining its contour in the bending process into the position of FIG. 8 where it is approximately perpendicular to the longitudinal axis of the drum and extends transversely outward with respect to the side wall 32 of the drum.

Figure 9:
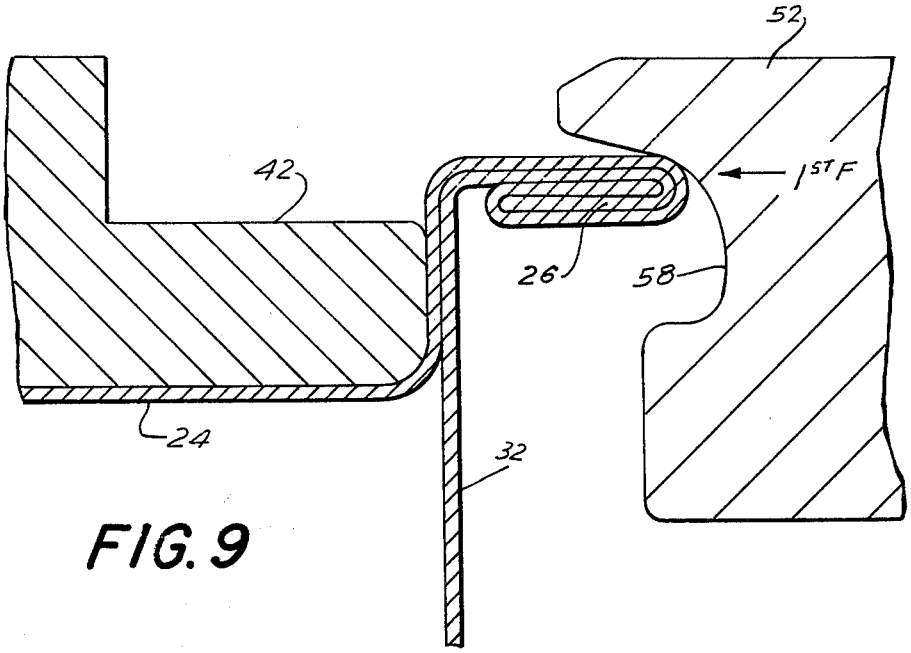
FIG. 9 is an enlarged fragmentary sectional view thereof with the approximate 90° bent seam of FIG. 8 being engaged by a further portion of the forming apparatus.
Figure 10:
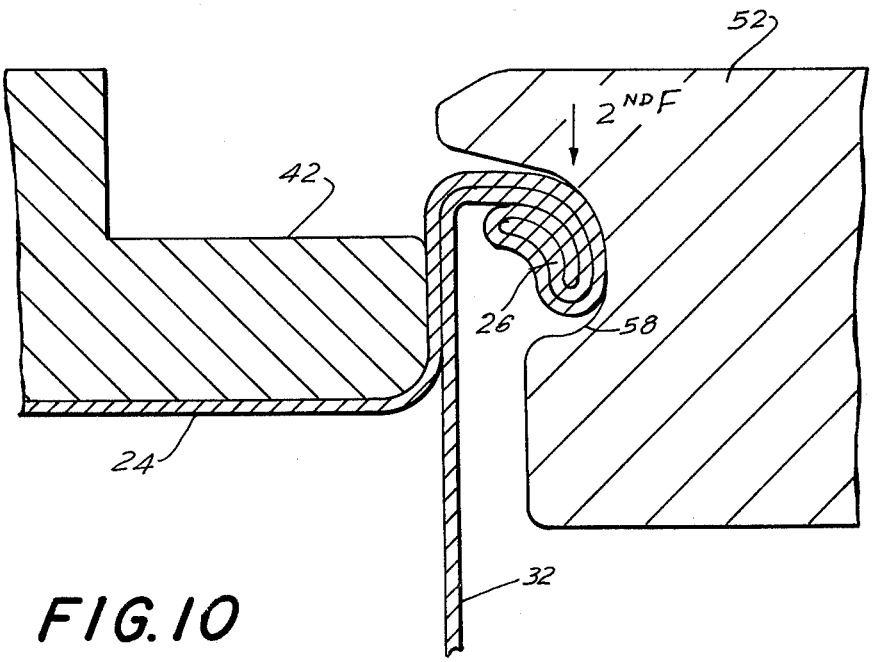
FIG. 10 is an enlarged fragmentary sectional view thereof with the forming apparatus having partially engaged the approximate 90° bent seam and further forming the seam toward the final configuration.
Figure 11:
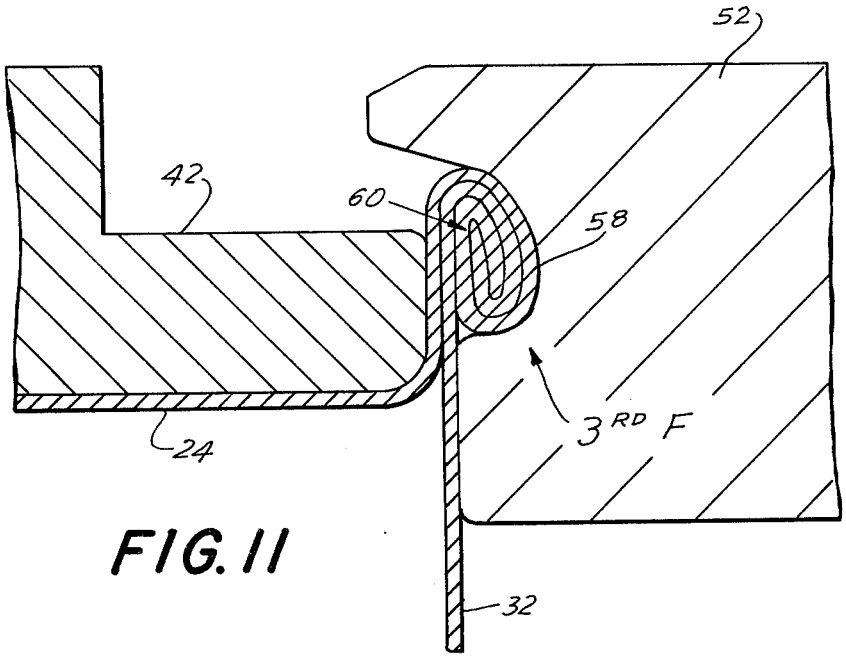
FIG. 11 is an enlarged fragmentary sectional view thereof with the forming apparatus having formed the seven ply seam of desired configuration.

Thereafter, support roll 46 and flat roll 50 retract and the power contour roll 52 moves into engagement with the transversely extending bent seam 26. The engaging surface 58 of contour roll 52 has a predetermined configuration for engagement with the transversely extending chime 26 so as to form it into the final configuration. As shown in FIG. 9, the first contact is to apply a force directly inward toward the side wall 32 of the drum as chime 26 is contacted. Thereafter, as shown in FIG. 10, as the contour roll is brought further into contact with seam 26 and in the direction toward the drum 20, a vertical or axial force is applied to the seam to bend and direct it downward. Finally, as shown in FIG. 11, the shape of engaging surface 58 is such that the seam 26 is finally bent back against the side wall 32 of the shell and the adjacent closure surface to form a seven ply seam 60. As this final seam 60 is formed a third upward force is applied by the bottom portion of the contour surface 58 of roll 52 so as to compress the seam 60 to provide a seam of minimum length while retaining the improved sealing characteristics and shaping of the seven ply structure.

Figure 12:
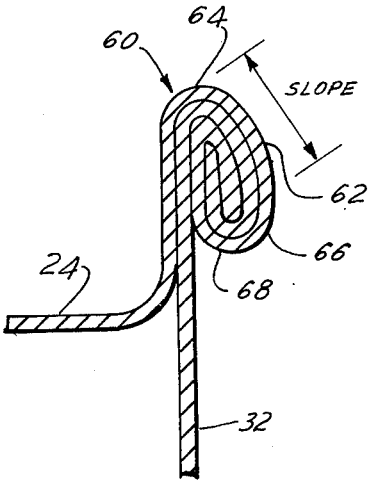
FIG. 12 is a fragmentary sectional view of the container showing the seven ply seam in final configuration with each seam or layer shown distinctly.

This contour forming of the seven ply reinforced chime produces a seam 60 as shown in FIG. 12 in the final product of minimum height or length with respect to the length of the side wall 32 of the drum. Additionally, the reinforced chime 60 includes a long sloping radius 62 from the end 64 to the beginning of the flat portion 66 of the seam 60. This provides maximum surface engagement against the floor when the drum 20 is rolled on edge. Compression of the other end portion 68 of the reinforced chime or seam 60 in the manner depicted in FIG. 11, forcing the seam upward provides for a very tight seam with little chance of spacing between the layers of metal. In this manner, a sealed drum is provided with a reinforced chime 60 with increased sealing, handling and strength characteristics while retaining a minimum desired length for the seam 60. As stated above, this type of seam can be provided at both the top and bottom ends of a drum 20.

Figure 13:
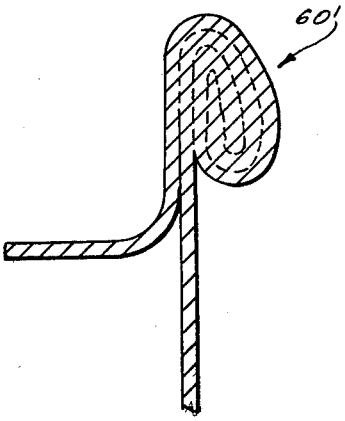
FIG. 13 is a fragmentary sectional view of the container with a seam of the final seven ply configuration and formed as an alternative solid mass.

Alternatively, as shown in FIG. 13, the reinforced chime 60' can be formed in the same manner as chime 60 of the previously discussed embodiment and, with the use of suitable pressure and perhaps heat, the chime 60' is formed into an essentially solid mass so as to provide for further desired sealing characteristics where necessary in regard to use with certain products for the container. The layers of a seven ply seam of this type are not readily discernable with the naked eye presumably as a result of the flow of metal of the layers into an essentially adhesive mass.

An advantage of the forming apparatus 34 is the superior contour roll 52 designed merely to move horizontally to form the reinforced chime 60. A standard five ply end closure drum can be quickly and efficiently transformed into a seven ply end closure drum. It is significant that the configuration of the contour surface 58 of contour roll 52 provides a wider surface for rolling the drum in that an increased surface area is provided as distinct from an edge. In dealing with thin gauge metal, rolling on an edge could cause rupture or failure at such locations. Rolling on an increased bearing area prevents this from happening. As stated above, the intermediate portion of contour surface 58 provides for an increased gradual sloped surface area to facilitate rolling of the drum. Also, the contour 58 of the contour roll 52 has a bottom portion with a predetermined bevel so that a camming action is provided which forces the bead tighter to provide additional strength. It not only tightens but compacts the bead.

The ends may be worked on individually or both ends can be worked on simultaneously.

The compact reinforced chime 60 is of a relatively short length. In fact, it has been found that the length of the five ply chime 26 is much larger than the seven ply reinforced chime 60 because of the compacting action. By reducing the length of the seam, a more compact bead or chime is provided. In other words, chime 60 adds two layers of thickness but is not two layer thicker in length than chime 26 due to the compacting action. The draw is approximately $\frac{3}{4}$ to 1 inch deep with a standard five ply seam drum.

The top and bottom discs or chucks are raised in a conventional manner such as by hydraulic means from a retracted position to an operative position to facilitate the grabbing of the drum 20 between the two chucks. When the drum goes up as a lower chuck assumes its operative position, the top chuck is inserted into the interior of the end. The top chuck rest right on top of the closure and engages rather tightly the inner edge of the apron of the five ply chime formation.

The outer rolls are pivoted on a rotatable arm. Cylindrical support roll 46 engages the outside of the drum just below the five ply chime 26.

Angle roll 48 rotates about a horizontal axis and comes into contact with the drum from above and includes a cylindrical outer surface and a tapered surface. This horizontally rotatable roller 48 is lowered as the drum 20 starts spinning. Upper chuck 42 is rotated in a conventional manner such as by a drive chain and lower chuck 40 can be rotated in a conventional manner such as being mounted on ball bearings to rotate with the drum and top chuck.

Angle roll 48 turns the bead approximately 40°–45° with respect to the horizontal. Angle roll 48 then rises and flat roll 50, which is cylindrical, turns the five ply chime horizontal to a transverse position approximately normal to the axis of the drum 20. Due to the inherent spring back of the metal the bend is not totally equal to 90° but is normally just a few degrees less. The drawings show the position as being 90° with respect to the vertical axis of the drum, however, there is inherent spring back. In bending the chime 26 to the flat position, drum 20 rotates a number of revolutions for each operation. An appropriate number of revolutions is chosen and is a matter of choice in order to spin the metal without tearing it and assuring the full degree of bending. For example, 25–30 revolutions per operation can be used in the actual formation of the seam.

The final forming operation is provided by the horizontal introduction of the contour roll which forms the seven ply chime 60 as described above. The contour roll 52 is introduced after the flat roll 50 and support roll 46 have been retracted. After final formation of seven ply chime 70, the contour roll 52 retracts and the finished drum can be removed from the apparatus 34 with a resultant seam as depicted in FIG. 12.

An actual practice, the entire operation can be accomplished in a relatively short period of time at relatively high speeds, for example 3 seconds.

It should be understood, that this invention envisions the formation of a seam having more than five plys and a seam of at least seven or more plys.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. A method of forming a sealed drum with a sealed end closure comprising; initially providing a tubular shell defining drum side walls and an end closure applied to at least one end of the shell with the adjacent peripheral edges of the shell and closures being formed into a substantially conventional circumferentially extending chime with the peripheral edges defining said chime being in abutting surface-to-surface contact and folded to provide a substantially conventional five ply seam with at least five layers of material of said edges being in a transverse radial direction with each layer extending in essentially the same direction as the drum side walls, and forming said chime into a reinforced chime folded to provide a seam of predetermined shape with more than five layers of material of said edges being in a transverse radial direction and having increased sealing, handling, and strength characteristics while retaining a minimum desired length for the seam.

2. The invention in accordance with claim 1 wherein an end closure is provided at both ends of the shell.

3. The invention in accordance with claim 1 wherein the shell and end closure containing the chime is held in fixed position, the chime is then bent to approximately 45° transverse with respect to the longitudinal axis of the drum, the bent chime is then bent into a transverse position with respect to the longitudinal axis of the drum by use of bending rolls configured to assist the seam to retain its contour in the bending process, the chime being then formed into the final reinforced chime configuration by use of a power roll of predetermined shape with the reinforced chime being bent inward against the adjacent side wall of the drum and conforming to the compact shape of the power roll to provide a seam of predetermined configuration.

4. The invention in accordance with claim 3 wherein the configuration of the power roll is such that the ultimate reinforced chime has a long sloping radius from the bottom of the seam to an intermediate flat outer surface to provide maximum surface against the floor when rolling the drum on edge, the relatively short flat portion extending into a compressed upper portion of the seam to provide a tight reinforced seam of minimum length.

5. A method of manufacturing a drum with a sealed end closure which comprises; initially providing a tubular shell defining drum side walls and an end closure applied to at least one end of the shell with the adjacent peripheral edges of the shell and closure having been formed into a substantially conventional circumferentially extending chime with the peripheral edges defining said chime being in abutting surface-to-surface contact and folded to provide a substantially conventional five ply seam with five layers of material of said edges being in a transverse radial direction with each layer extending in essentially the same direction as the drum side walls, and the chime being thereafter formed into a reinforced chime folded to provide a seam of predetermined shape with seven layers of material of said edges being in a transverse radial direction and having increased sealing, handling, and strength characteristics while retaining a minimum desired length for the seam.

6. The invention in accordance with claim 5 wherein an end closure is similarly applied at both ends of the shell.

7. The invention in accordance with claim 5 wherein the shell and end closure containing the chime is held in fixed position, the chime is then bent to approximately 45° transverse with respect to the longitudinal axis of the drum, the bent chime is then bent into a transverse position with respect to the longitudinal axis of the drum by use of bending rolls configured to assist the seam to retain its contour in the bending process, the chime being then formed into the final reinforced chime configuration by use of a power roll of predetermined shape with the reinforced chime being bent inward against the adjacent side wall of the drum and conforming to the compact shape of the power roll to provide a seam of predetermined configuration.

8. The invention in accordance with claim 7 wherein the configuration of the power roll is such that the ultimate reinforced chime has a long sloping radius from the bottom of the seam to an intermediate flat outer surface to provide maximum surface against the floor when rolling the drum on edge, the relatively short flat portion extending into a compressed upper portion of the seam to provide a tight reinforced seam of minimum length.

9. A drum provided by the method of claim 5 having a seven ply multiple seam end closure having certain dimensions that are smaller than that of the five ply, double seam initially formed to provide a compact, seven ply multiple seam of increased sealing, handling and strength characteristics.

* * * * *